US009351627B2

(12) United States Patent
Disch

(10) Patent No.: US 9,351,627 B2
(45) Date of Patent: May 31, 2016

(54) DISHWASHING MACHINE AND METHOD FOR THE OPERATION THEREOF

(75) Inventor: Harald Disch, Elzach (DE)

(73) Assignee: PREMARK FEG L.L.C., Glenview, IL (US)

( * ) Notice: Subject to any disclaimer, the term of this patent is extended or adjusted under 35 U.S.C. 154(b) by 1464 days.

(21) Appl. No.: 12/745,901

(22) PCT Filed: Nov. 25, 2008

(86) PCT No.: PCT/EP2008/066141

§ 371 (c)(1),
(2), (4) Date: Jun. 3, 2010

(87) PCT Pub. No.: WO2009/071466

PCT Pub. Date: Jun. 11, 2009

(65) Prior Publication Data

US 2010/0269863 A1 Oct. 28, 2010

(30) Foreign Application Priority Data

Dec. 6, 2007 (DE) ..... 10 2007 059 030

(51) Int. Cl.

| | |
|---|---|
| ***B08B 9/20*** | (2006.01) |
| ***A47L 15/42*** | (2006.01) |
| ***A47L 15/00*** | (2006.01) |

(52) U.S. Cl.

CPC ..... *A47L 15/4234* (2013.01); *A47L 15/0007* (2013.01); *A47L 15/0015* (2013.01); *A47L 15/0078* (2013.01); *A47L 15/4217* (2013.01); *A47L 2601/04* (2013.01)

(58) Field of Classification Search

None

See application file for complete search history.

(56) References Cited

U.S. PATENT DOCUMENTS

2005/0268668 A1 12/2005 Miyauti et al.

FOREIGN PATENT DOCUMENTS

| | | |
|---|---|---|
| DE | 2900954 | 7/1979 |
| DE | 4233936 | 4/1994 |
| EP | 0808894 | 11/1997 |
| EP | 1586263 | 10/2005 |
| EP | 1657297 | 5/2006 |
| EP | 1347039 | 8/2007 |
| WO | 2006/037447 | 4/2006 |
| WO | 2006/129963 | 12/2006 |

OTHER PUBLICATIONS

EPO machine translation of EP 1347039.*

(Continued)

*Primary Examiner* — Eric Golightly

(74) *Attorney, Agent, or Firm* — Thompson Hine LLP

(57) ABSTRACT

A dishwashing machine is designed to perform the following process steps: Step 1: a pretreatment cycle spraying the washing goods with an alkaline, highly concentrated cleaning solution, the pH value of which is at least 1 greater than the pH value of the washing liquid of a main washing cycle; Step 2 after Step 1: a soak cycle for a soak period, during which the cleaning solution acts on the washing goods and the washing goods are additionally thermally pretreated with steam, whereby the thermal pretreatment of the washing goods is performed during at least one part of the soak period, preferably during the entire soak period; Step 3 after Step 2: a main washing cycle, comprising spraying of the washing goods with washing liquid comprising water and cleaner; Step 4 after Step 3: a clear rinse cycle, during which the washing goods are sprayed with clear rinse liquid.

8 Claims, 6 Drawing Sheets

(56) References Cited

OTHER PUBLICATIONS

PCT, Written Opinion, International Application No. PCT/EP2008/066141; 8 pages (completed Feb. 17, 2009; mailed Mar. 10, 2009), German language, conisidered to the extent it could be understood.
German Search Report, German Application No. 10 2007 059 030.1; 4 pages (Jun. 16, 2008).
PCT, International Search Report, International Application No. PCT/EP2008/066141, 6 pages (mailed Mar. 10, 2009; published Jun. 11, 2009).
PCT, Written Opinion, International Application No. PCT/EP2008/066141, 8 pages, German language, considered as far as could be understood.

* cited by examiner

DISHWASHING MACHINE AND METHOD FOR THE OPERATION THEREOF

TECHNICAL FIELD

The invention relates to a dishwashing machine, in particular a commercial dishwashing machine, and to a method for the operation thereof.

BACKGROUND

Dishwashing machines (warewashers), in particular commercial dishwashing machines, in the form of box-type dishwashing machines (box-type warewashers) may be hood-type dishwashing machines (hood-type warewashers) or frontloaders (frontloader warewashers).

A dishwashing machine (box-type warewasher) and a plurality of methods for the operation thereof are known, for example, from WO 2006/129963 A2. Said dishwashing machine is provided with a steam generator for treating the washware with steam during various process cycles. The use of steam is provided before a washing cycle or after a washing cycle. Treating washware with steam between a prewash cycle and a main wash cycle is also known from DE 29 00 954 A1.

EP 0 808 894 B1 discloses a method according to which the washware is sprayed with detergent solution (detergent) during a prewash cycle, before a main wash cycle and, following this, a final rinse cycle then take place. Spraying washware with a highly concentrated alkaline detergent solution is also known from EP 1 347 039 B1.

WO 2006/037447 A1 discloses a dishwashing machine in which washware is washed with washing liquid, then rinsed with fresh water, and then subjected to thermal aftertreatment with steam.

Since washware normally includes not only tableware, for example plates and cups, but also cutlery, for example spoons, forks and knives, and also other utensils, for example trays, pots and pans, dishwashing machines, in particular commercial dishwashing machines, are also called utensil washers (warewashers).

Commercial dishwashing machines or utensil washers normally operate in two main process steps: a 1st step which includes washing with a washing liquid, and a 2nd step which includes final rinsing with heated fresh water and the metered addition of a final rinse aid.

In order to be able to carry out these process steps, a commercial dishwashing machine is generally equipped with two independent liquid systems which are completely separate from one another. One of the liquid systems is a washing water circuit which is responsible for washing the washware, with washing being carried out using recirculated water from a washing tank. The other liquid system is a fresh water system which is responsible for final rinsing. Final rinsing is carried out with fresh water, preferably with fresh water from a water heater (boiler). The fresh water is likewise held by the washing tank after being sprayed.

The main objective of final rinsing is to remove washing liquor from the washware. In addition, the final rinse water which flows into the washing tank during the final rinse step serves to regenerate the washing water which is present in the washing tank.

Before fresh water is sprayed and thus conducted into the washing tank as final rinse liquid as a result of final rinsing, a quantity of washing liquid which is equal to the quantity of fresh water is pumped out of the washing tank.

Modern dishwashing machines are equipped with a plurality of programs. These programs differ mainly by virtue of program run times of the washing process step of different lengths. The customer has the option of selecting a short washing program for washware which is lightly soiled, or of selecting a correspondingly longer washing program for washware which is heavily soiled.

The proportion of washware which is heavily soiled, for example contains burnt-on food residues, is frequently very high, particularly in the case of commercial dishwashing machines or utensil washers. Since cookware, heat-retaining boxes or baking tins and baking trays with burnt-on food residues, for example, are washed in dishwashing machines of this type, such washware is prewashed or postwashed in many cases since "normal" machine washing is not able to provide a satisfactory wash result, even with relatively long run times of the programs.

The object of the invention is to provide an option by means of which the wash process can be shortened in an ergonomical and environmentally friendly manner.

SUMMARY

The invention accordingly relates to a dishwashing machine or utensil washer which is in the form of a box-type dishwashing machine and is designed to carry out the following method steps:

step 1: carrying out a pretreatment cycle comprising spraying the washware with an alkaline, highly concentrated detergent solution whose pH is at least 1 higher than the pH of the washing liquid of a main washing cycle;

following step 1, step 2: carrying out an action cycle over an action time period during which the detergent solution acts on the washware and the washware is additionally thermally pretreated with steam, with the thermal pretreatment of the washware being carried out over at least a portion of the action time period, preferably over the entire action time period;

following step 2, step 3: carrying out a main washing cycle comprising spraying the washware with washing liquid which contains water and detergent;

following step 3, step 4: carrying out a final rinse cycle during which the washware is sprayed with final rinse liquid.

By virtue of the invention, two process steps in which steam is used in combination with a highly concentrated alkaline detergent solution to remove dirt which is located on the washware, in particular dirt in the form of food residues or other foodstuff residues, precede the washing cycle.

The highly concentrated, alkaline detergent solution is sprayed onto the washware which is located in the treatment chamber of the dishwashing machine or the utensil washer. During the following action cycle, an action time period is integrated in the program sequence during which the highly concentrated, alkaline detergent solution can act on the washware and during which steam is additionally introduced into the treatment chamber, for example into the region of the washware and there sprayed onto the washware.

On account of the combination of the simultaneous action of highly concentrated, alkaline detergent and simultaneous thermal treatment of the washware with steam, the molecular structures of the dirt (food residues, foodstuff residues etc.) on the washware is broken down, with the dirt becoming detached from the washware. Following the abovementioned pretreatment with highly concentrated, alkaline detergent solution and simultaneous thermal treatment with steam, the main wash step is executed, which step can proceed in a conventional manner. The main wash step can be assisted by hot steam which is introduced into the treatment chamber during the main wash step, in order to promote the washing efficiency.

On account of the uniform distribution of steam, steam has an advantage over a conventional washing cycle, predominantly in shadow zones of the washware. Steam reaches every surface of the washware within the treatment chamber equally, irrespective of the position and the orientation of the washware, for example of the plates, cups, trays, pans and pots.

BRIEF DESCRIPTION OF THE DRAWINGS

The invention is described below with reference to the associated drawings on the basis of preferred embodiments of the invention as examples. In the drawings FIG. 1 schematically shows a dishwashing machine according to the invention, FIG. 2 schematically shows a further embodiment of a dishwashing machine according to the invention, FIG. 3 schematically shows a further embodiment of a dishwashing machine according to the invention, FIG. 4 schematically shows a further embodiment of a dishwashing machine according to the invention, FIG. 5 schematically shows a further embodiment of a dishwashing machine according to the invention, and FIG. 6 schematically shows a further embodiment of a dishwashing machine according to the invention.

DETAILED DESCRIPTION

Figure 1:
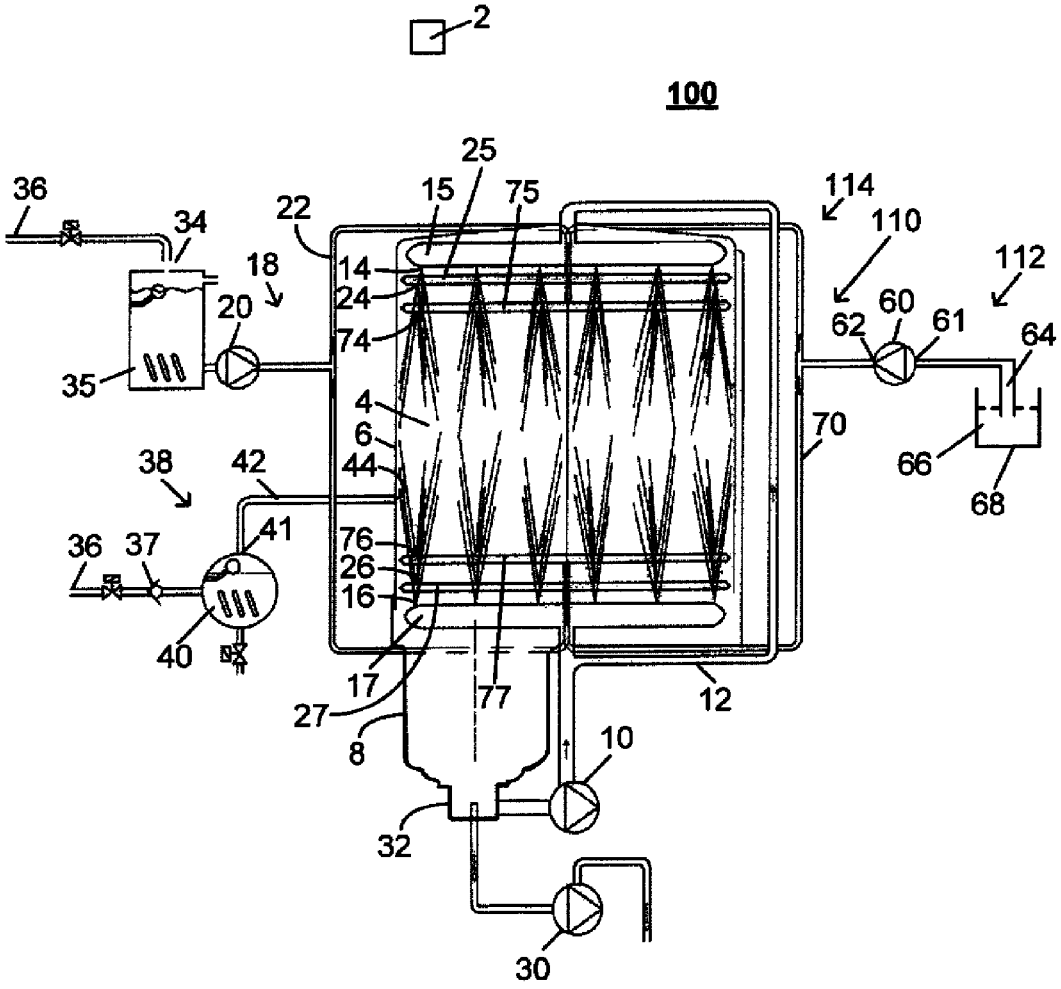

FIGS. 1 to 6 show six different embodiments of dishwashing machines 100, 200, 300, 400, 500 and 600 according to the invention.

The invention relates to dishwashing machines, in particular commercial dishwashing machines, which can also be called utensil washers (warewashers), in the form of a box-type dishwasher. Said dishwashing machines contain a program-control device 2 for controlling at least one wash program and a treatment chamber 4, which can be closed by a door (not shown) or a hood (not shown), in a machine housing 6 for accommodating washware (not shown) to be washed, for example tableware, cutlery, pots, pans and trays.

A washing tank 8 for holding sprayed liquid from the treatment chamber 4 is located beneath the treatment chamber 4. A washing pump 10 is provided for conveying washing liquid from the washing tank 8, through a washing liquid line system 12, to washing nozzles 14 and 16 which, in the treatment chamber 4, are directed at the region of the washware to be washed and spray the washing liquid onto the washware to be washed. The sprayed washing liquid falls back into the washing tank 8 due to the force of gravity. As a result, the washing tank 8, the washing pump 10, the washing liquid line system 12, the washing nozzles 14 and 16, together with the wash chamber 4, form a washing liquid circuit. The washing liquid line system 12 connects the pressure side of the washing pump 10 to the washing nozzles 14 and 16.

Furthermore, a final rinse apparatus 18 is provided for conveying final rinse liquid by means of a final rinse pump 20, through a final rinse liquid line system 22, to final rinse nozzles 24 and 26 which, in the treatment chamber 4, are directed at the region of the washware to be washed. The sprayed final rinse liquid falls from the treatment chamber 4 into the washing tank 8 due to the force of gravity. The final rinse liquid line system 22 connects the pressure side of the final rinse pump 20 to the final rinse nozzles 24 and 26.

The washing nozzles 14 and 16 and the final rinse nozzles 24 and 26 can be arranged in the regions above and/or below and possibly also to the side of the region of the washware and can in each case be directed toward the region in which the washware is positioned.

A large number of washing nozzles 14 is preferably provided on at least one upper washing arm 15, a large number of washing nozzles 16 is preferably provided on at least one lower washing arm 17, a large number of final rinse nozzles 24 is preferably provided on at least one upper final rinse arm 25 and a large number of final rinse nozzles 26 is preferably provided on at least one lower final rinse arm 27.

Before the final rinse liquid is sprayed, a quantity of washing liquid which corresponds to the final rinse liquid is in each case pumped out of the washing tank 8 by means of a discharge pump 30 whose suction side is connected to a sump 32 of the washing tank 8.

If the washing tank 8 is empty before the dishwashing machine is first started, it first has to be filled with fresh water via a fresh water line (not shown) or with fresh water or with another final rinse liquid by means of the final rinse apparatus 18 and its final rinse pump 20.

The final rinse liquid may be fresh water or fresh water mixed with final rinse aid.

The washing liquid contains detergent which is automatically added in a metered manner to the liquid which is contained in the washing tank 8 by a detergent metering apparatus (not shown).

All the dishwashing machines of the invention contain a steam apparatus with a steam generator for generating steam and introducing steam into the treatment chamber, in order to subject the washware to the action of steam in said treatment chamber. The steam apparatus can be implemented in various embodiments. Examples are illustrated in FIGS. 1 to 6.

The differences between the various embodiments 100 to 600 which are illustrated in FIGS. 1 to 6 are described below.

Figure 2:
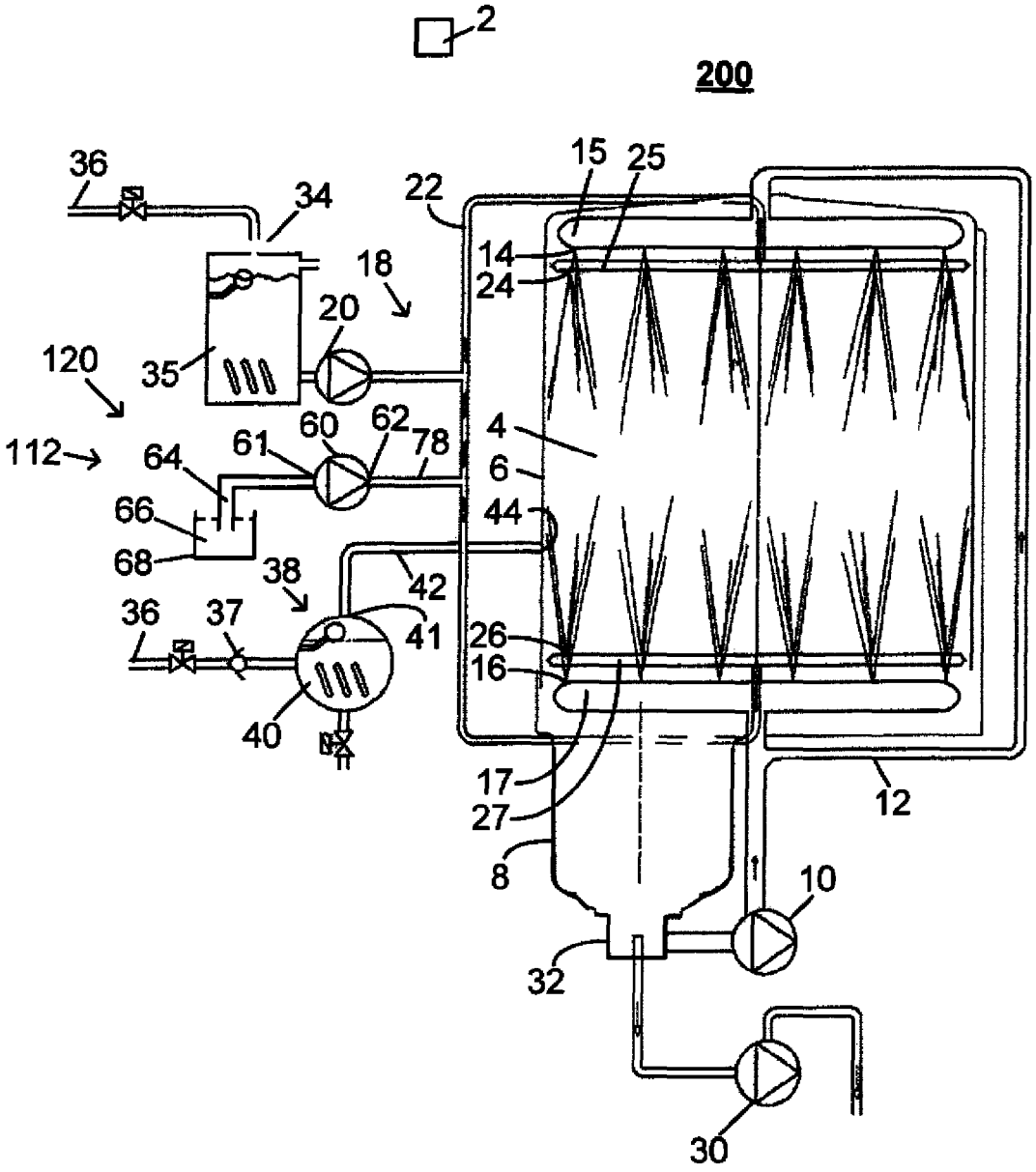
Figure 3:
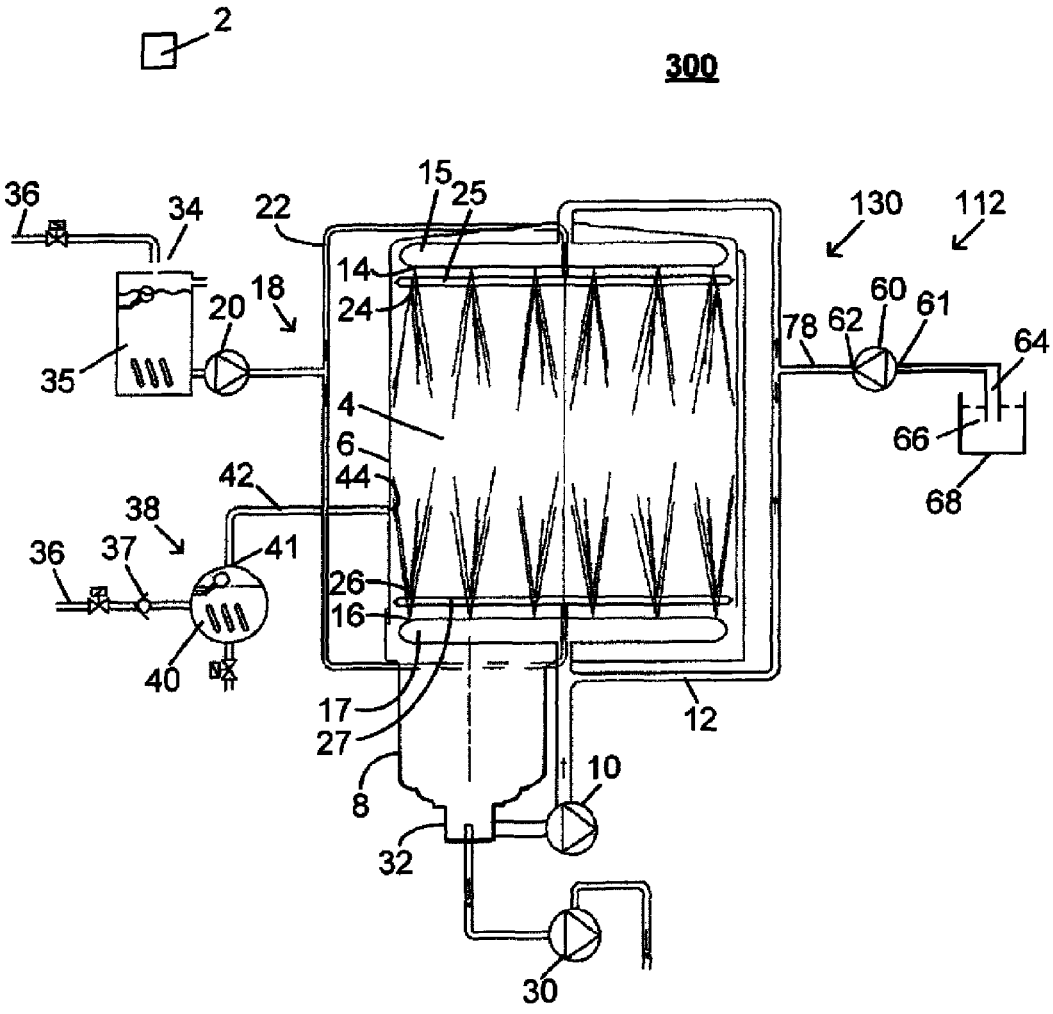

In the dishwashing machines 100, 200 and 300 of FIGS. 1, 2 and 3, the suction side of the final rinse pump 20 can be connected to a fresh water connection 36 via a return-prevention means 34. The return-prevention means 34 (air gap) prevents liquid returning from the final rinse liquid line system 22 to the public water supply system via the fresh water connection 36. A water heater 35 can be located between the return-prevention means 34 and the suction side of the final rinse pump 20.

The dishwashing machines 100, 200 and 300 of FIGS. 1, 2 and 3 are provided with a steam apparatus 38 which contains a steam generator 40 whose steam side 41 is connected to the treatment chamber 4 via a steam line 42 and whose water side can be connected to a fresh water connection 36, for example via a non-return valve 37. The downstream end 44 of the steam line 42 ends, for example, in a side wall of the treatment chamber 4.

The steam generator 40 can also be integrated in the dishwashing machine in such a way that its steam outlet 41 issues directly into the treatment chamber 4, without the steam line 42. By way of example, the steam generator 40 can be arranged beneath the treatment chamber 4.

Figure 4:
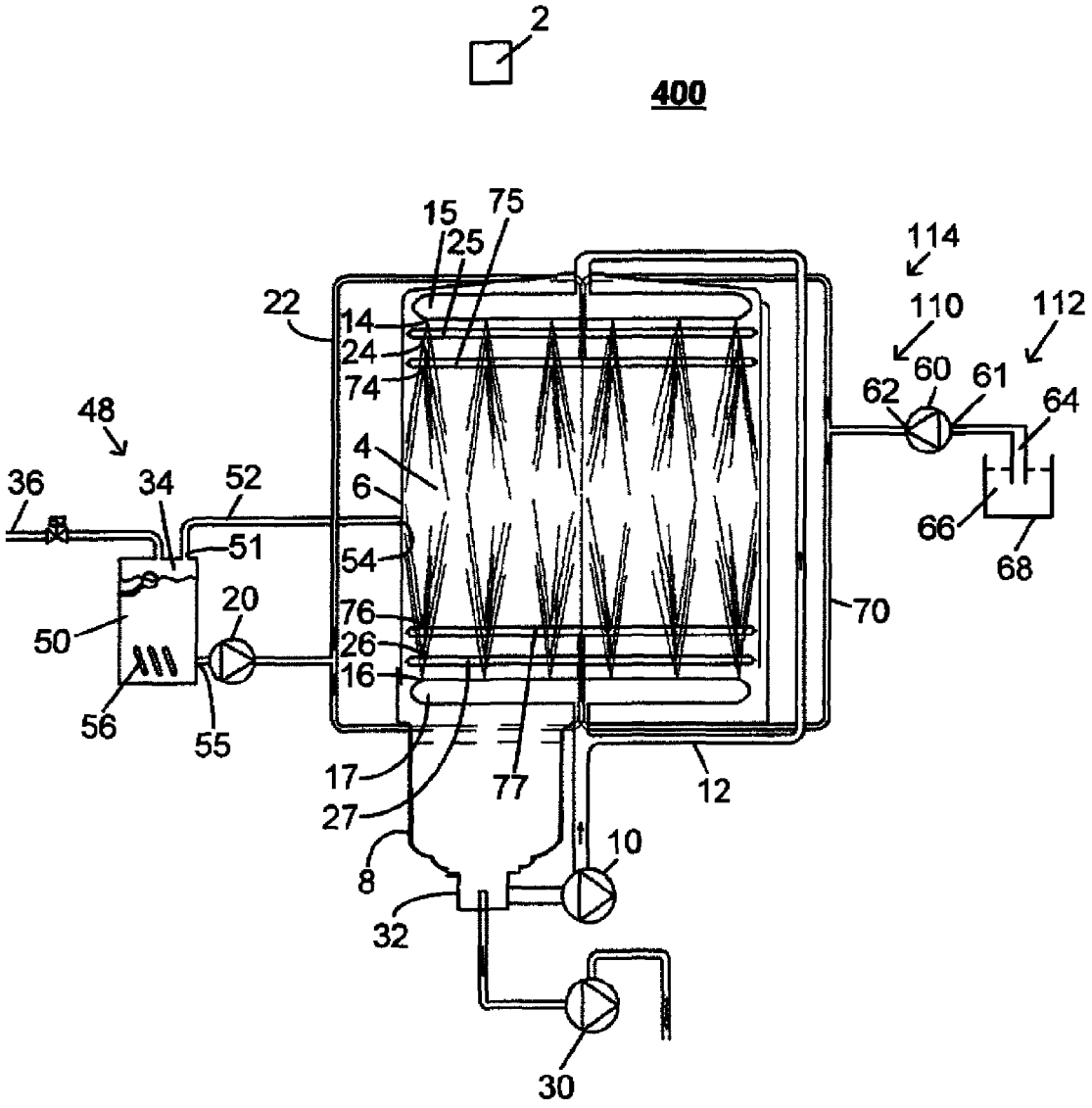
Figure 5:
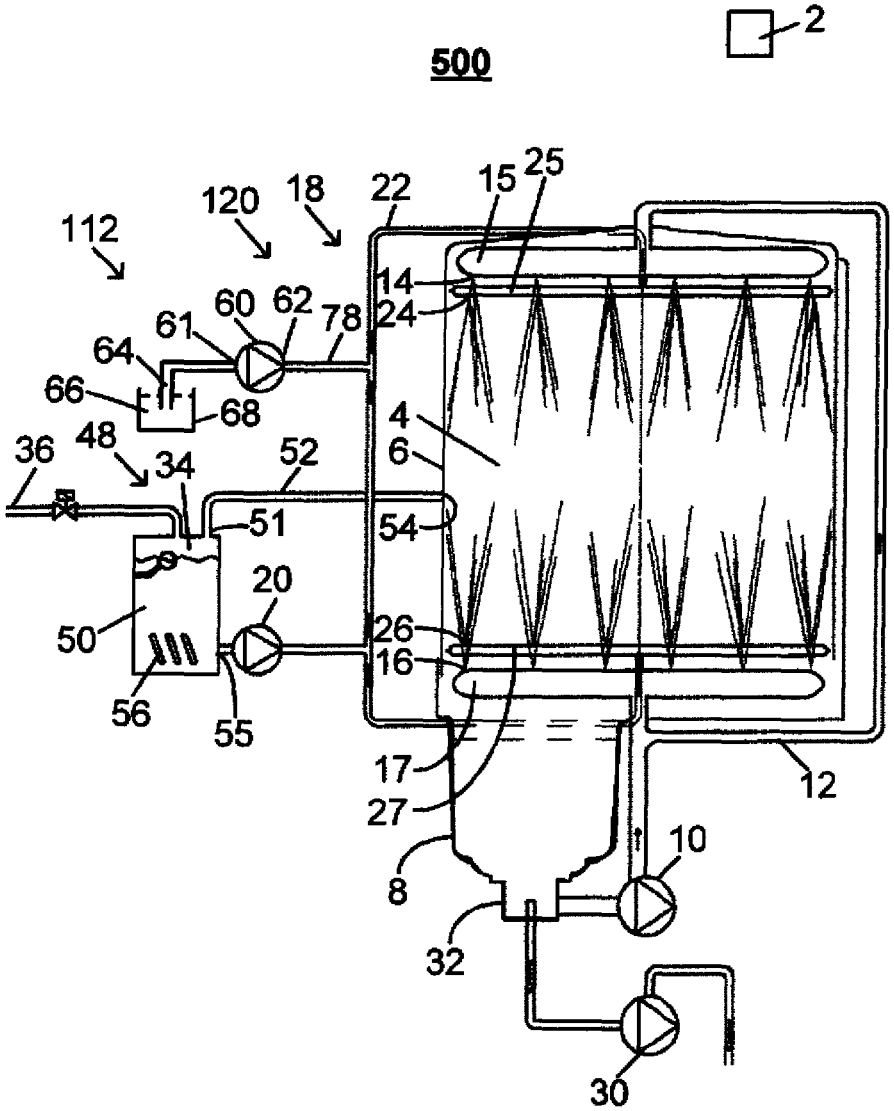
Figure 6:
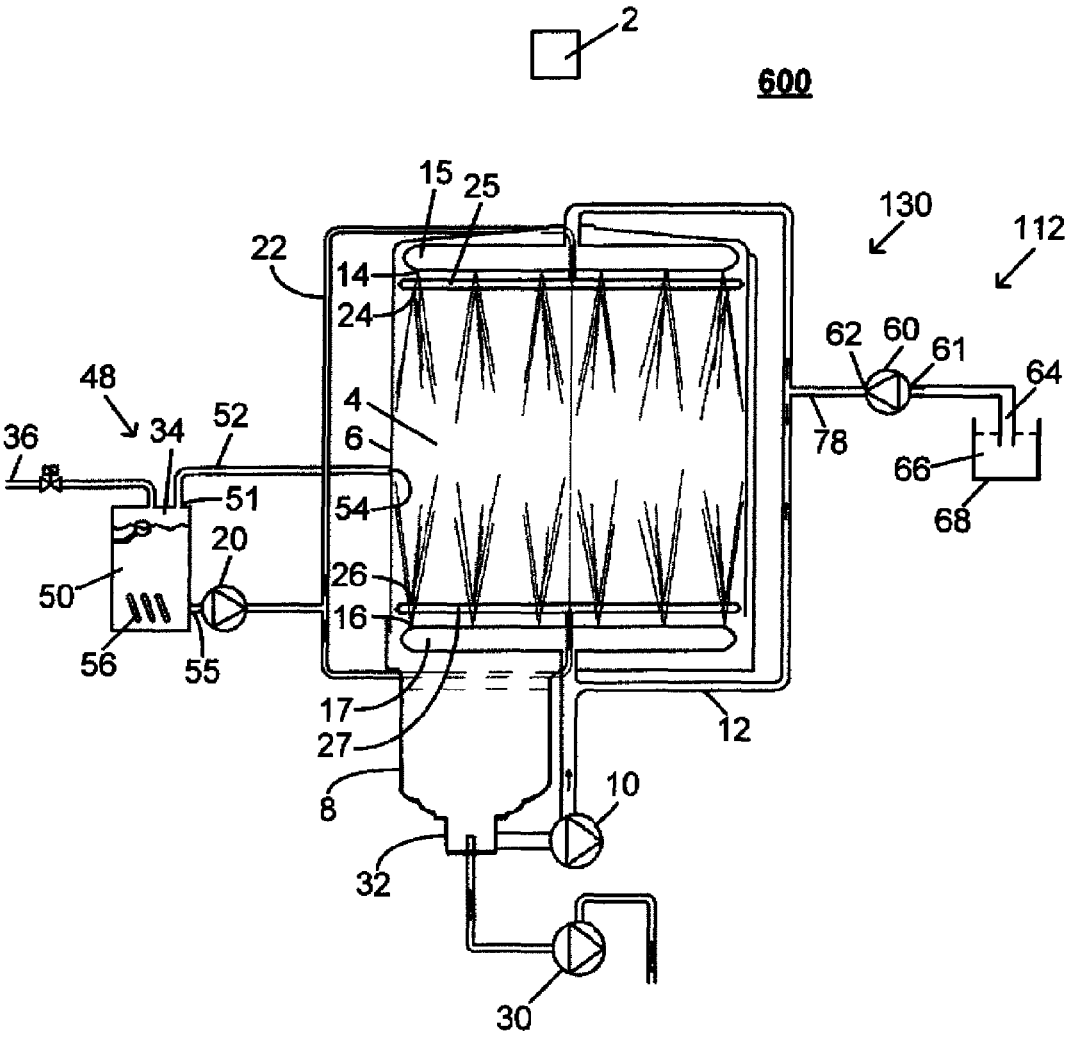

In the dishwashing machines 400, 500 and 600 of FIGS. 4, 5 and 6, a combined water heater and steam apparatus 48 is provided instead of the steam apparatus 38. The water heater and steam apparatus 48 contains a steam generator 50. The steam generator 50 can be connected to a fresh water connection 36 and has a steam outlet 51 which, for example via a steam line 52, issues into the treatment chamber 4, for example by means of a steam outlet opening 54 in a side wall of the treatment chamber 4. Furthermore, the steam generator 50 has a final rinse liquid outlet 55 which is connected to the suction side of the final rinse pump 20 for the purpose of conveying final rinse liquid through the final rinse liquid line system 22 to the final rinse nozzles 24 and 26.

The steam generator 50 contains a heating system 56. Steam or heated final rinse liquid can be produced by said heating system.

The program-control device 2 of the dishwashing machines 100, 200, 300, 400, 500 and 600 of FIGS. 1 to 6 contains at least one wash program which is designed to carry out the following program steps:

step 1: carrying out a pretreatment cycle comprising spraying the washware with an alkaline, highly concentrated detergent solution whose pH is at least 1 higher than the pH of the washing liquid of a main washing cycle;

following step 1, step 2: carrying out an action cycle over an action time period during which the detergent solution acts on the washware and the washware is additionally thermally pretreated with steam, with the thermal pretreatment of the washware being carried out over at least a portion of the action time period, preferably over the entire action time period;

following step 2, step 3: carrying out a main washing cycle comprising spraying the washware with washing liquid which contains water and detergent;

following step 3, step 4: carrying out a final rinse cycle during which the washware is sprayed with final rinse liquid.

Spraying of the washware with the alkaline, highly concentrated detergent solution whose pH is at least 1 higher than the pH of the washing liquid of the main washing cycle can be performed in various ways.

According to one preferred embodiment of the invention, a supply and spray system is provided, by means of which the alkaline, highly concentrated detergent solution whose pH is at least 1 higher than the pH of the washing liquid of a main washing cycle can be conveyed out of a detergent solution container and sprayed onto the washware in the treatment chamber 4.

In the dishwashing machines 100 and 400 of FIGS. 1 and 4, a supply and spray system 110 is provided for the alkaline, highly concentrated detergent solution, which system comprises a supply apparatus 112 and a spray apparatus 114. The supply apparatus 112 contains a detergent solution pump 60 with a suction side 61 and a pressure side 62. A suction line 64 for conveying alkaline, highly concentrated detergent solution 66 from a detergent solution container 68 is connected to the suction side 61.

The spray apparatus 114 comprises a detergent solution line system 70 which is connected to the pressure side 62 of the detergent solution pump 60, and detergent solution nozzles, for example detergent solution nozzles 74, which are connected to said detergent solution line system and are formed in a detergent solution arm 75 which is preferably arranged above the region of the washware of the wash chamber 4, and/or detergent solution nozzles 76 which are formed in a detergent solution arm 77 which is preferably arranged below the region of the washware of the detergent chamber 4.

The washing machines 200 and 400 of FIGS. 2 and 4 again have the supply apparatus 112 for the alkaline, highly concentrated detergent solution, but a separate spray apparatus 114 is not provided here and instead the pressure side 62 of the detergent solution pump 60 is connected to the final rinse liquid line system 22 via a connection line 78. As a result, final rinse liquid or the alkaline, highly concentrated detergent solution 66 can be alternately sprayed onto the washware via the final rinse nozzles 24, 26. The supply and spray system 120 for the highly concentrated detergent solution of these dishwashing machines 200 and 400 therefore comprises the supply apparatus 112 and the final rinse liquid line system 22 and also the final rinse nozzles 24 and 26.

In the dishwashing machines 300 and 600 of FIGS. 3 and 6, a supply and spray system 130 is provided for the alkaline, highly concentrated detergent solution, which system again contains the supply apparatus 112 but not the spray system 114. The spray system used is the washing liquid spray system, since the pressure side 62 of the detergent solution pump 60 is connected to the washing liquid line system 12 via a connection line 78. As a result, washing liquid or the alkaline, highly concentrated detergent solution 66 can be alternately sprayed by means of the washing nozzles 14 and 16.

The program-control device 2 controls the washing pump 10, the final rinse pump 20, the outflow pump 30 and the detergent solution pump 60 as a function of the wash program respectively selected on the program-control device 2 by an operator. At least one wash program is provided; a plurality of optionally selectable wash programs is preferably provided.

According to the invention, the at least one wash program can be designed in such a way that the introduction of steam into the treatment chamber for the thermal pretreatment of the washware according to step 2 is started as early as after the beginning but before the end of step 1, preferably during the last quarter of the duration of step 1.

Furthermore, the at least one wash program can be designed in such a way that the washware is sprayed with an alkaline, highly concentrated detergent solution according to step 1 over a time period in the range of between 5 seconds and 30 seconds, preferably between 10 seconds and 20 seconds.

According to a further embodiment of the invention, the detergent program can be designed in such a way that steam thermally acts on the washware during said step 2 over a time period in the range of between 0.5 minutes and 7 minutes, preferably in a range of between 1 minute and 4 minutes.

In order to shorten the wash time period, it may also be advantageous for steam to also be introduced into the wash chamber and the washware to be subjected to the action of the steam at least over a portion of the time period during which the washware is sprayed with washing liquid according to step 3.

It is particularly advantageous if, according to the invention, the wash program involves washing liquid which contains detergent and has a pH in a range of between 9.0 and 11, preferably between 9.5 and 10.5, being used as the washing liquid for carrying out the main washing cycle according to step 3.

Furthermore, provision may advantageously be made in the wash program for the pH of the alkaline, highly concentrated detergent solution for spraying the dishes according to step 1 to be at least 11.

Furthermore, the at least one wash program for washing washware which is heavily soiled and/or contains firmly adhering dirt may involve a prewash step during which the washware is sprayed with liquid, preferably washing liquid containing detergent, being carried out before the dishes are sprayed with an alkaline, highly concentrated detergent solution according to step 1.

The invention claimed is:

1. A method for the operation of a box-type dishwasher having a treatment chamber for washing washware, characterized by the following steps:

step 1: carrying out a pretreatment cycle comprising spraying the washware with an alkaline detergent solution whose pH is at least 1 higher than a pH of a washing liquid of a main washing cycle;

following step 1, step 2: carrying out an action cycle over an action time period during which the detergent solution acts on the washware and the washware is additionally thermally pretreated with steam, with the thermal pretreatment of the washware with steam being carried out over at least a portion of the action time period;

following step 2, step 3: carrying out a main washing cycle comprising spraying the washware with washing liquid which contains water and detergent; and following step 3, step 4: carrying out a final rinse cycle during which the washware is sprayed with final rinse liquid;

wherein thermal treatment with steam also takes place during at least a portion of step 3 such that steam is introduced into the treatment chamber during the spraying of washware with wash liquid during at least the portion of step 3.

2. A method for the operation of a box-type dishwasher having a treatment chamber for washing washware, characterized by the following steps:

step 1: carrying out a pretreatment cycle comprising spraying the washware with an alkaline detergent solution whose pH is at least 1 higher than a pH of a washing liquid of a main washing cycle;

following step 1, step 2: carrying out an action cycle over an action time period during which the detergent solution acts on the washware and the washware is additionally thermally pretreated with steam, with the thermal pretreatment of the washware with steam being carried out over at least a portion of the action time period;

following step 2, step 3: carrying out a main washing cycle comprising spraying the washware with washing liquid which contains water and detergent;

following step 3, step 4: carrying out a final rinse cycle during which the washware is sprayed with final rinse liquid;

wherein an introduction of steam into the treatment chamber is started after the beginning but before the end of step 1 so that introduction of steam into the treatment chamber also takes place during at least a portion of the spraying of alkaline detergent solution of step 1; and wherein treatment with steam also take place during at least a portion of step 3 such that steam is introduced into the treatment chamber during the spraying of washware with wash liquid during at least the portion of step 3.

3. The method as claimed in claim 2, characterized in that the washware is sprayed with detergent solution according to step 1 over a time period in the range of between 5 seconds and 30 seconds.

4. The method as claimed in claim 3, characterized in that the thermal action of steam on the washware is carried out during said step 2 over a time period in the range of between 0.5 minutes and 7 minutes.

5. The method as claimed in claim 2, characterized in that washing liquid which contains detergent and has a pH in a range of between 9.0 and 11 is used as the washing liquid for carrying out the main washing cycle according to step 3.

6. The method as claimed in claim 1, characterized in that the pH of the alkaline detergent solution for spraying the dishes according to step 1 is at least 11.

7. The method as claimed in claim 1, characterized in that at least one prewash step during which the washware is sprayed with liquid containing detergent, is carried out before the dishes are sprayed with detergent solution according to step 1.

8. A box-type dishwasher, comprising a program-control device for controlling at least one wash program, a treatment chamber for accommodating washware to be washed; a washing tank for accommodating sprayed liquid from the treatment chamber; a washing pump for conveying washing liquid from the washing tank to washing nozzles which, in the treatment chamber, are directed at the region of the washware to be washed; final rinse nozzles which, in the treatment chamber, are directed at the region of the washware to be washed; a steam generator for generating steam and connected with a path for introducing steam into the treatment chamber and therein onto the washware to be washed;

characterized in that a supply of alkaline detergent solution is provided along with nozzles for spraying this detergent solution onto washware in the treatment chamber, and in that the program-control device for controlling at least one wash program and the at least one wash program are designed to carry out a method including the following steps:

step 1: carrying out a pretreatment cycle comprising spraying the washware with the detergent solution, where the detergent solution has a pH that is at least 1 higher than the pH of a washing liquid of a main washing cycle;

following step 1, step 2: carrying out an action cycle over an action time period during which the detergent solution acts on the washware and the washware is additionally thermally pretreated by introduction of steam into the treatment chamber, with the thermal pretreatment of the washware with steam being carried out over at least a portion of the action time period;

following step 2, step 3: carrying out the main washing cycle comprising spraying the washware with washing liquid which contains water and detergent, and during at least part of the spraying of washware with washing liquid in step 3 steam is at the same time introduced into the treatment chamber; and following step 3, step 4: carrying out a final rinse cycle during which the washware is sprayed with final rinse liquid.

* * * * *